US011952647B2

(12) United States Patent
Seol et al.

(10) Patent No.: US 11,952,647 B2
(45) Date of Patent: Apr. 9, 2024

(54) METHOD FOR MANUFACTURING FERRITIC LIGHTWEIGHT STEEL AND FERRITIC LIGHTWEIGHT STEEL USING SAME

(71) Applicant: INDUSTRY-ACADEMIC COOPERATION FOUNDATION GYEONGSANG NATIONAL UNIVERSITY, Jinju-si (KR)

(72) Inventors: Jae Bok Seol, Jinju-si (KR); Hyo Ju Bae, Jinju-si (KR); Kwang Gyu Koh, Jinju-si (KR); Jung Gi Kim, Jinju-si (KR); Hyo Kyung Sung, Jinju-si (KR); Young Kook Lee, Seoul (KR)

(73) Assignee: INDUSTRY-ACADEMIC COOPERATION FOUNDATION GYEONGSANG NATIONAL UNIVERSITY, Jinju-si (KR)

( * ) Notice: Subject to any disclaimer, the term of this patent is extended or adjusted under 35 U.S.C. 154(b) by 0 days.

(21) Appl. No.: 18/039,655

(22) PCT Filed: Nov. 11, 2021

(86) PCT No.: PCT/KR2021/016379
§ 371 (c)(1),
(2) Date: May 31, 2023

(87) PCT Pub. No.: WO2022/124601
PCT Pub. Date: Jun. 16, 2022

(65) Prior Publication Data

US 2023/0392238 A1 Dec. 7, 2023

(30) Foreign Application Priority Data

Dec. 10, 2020 (KR) ..... 10-2020-0172118

(51) Int. Cl.
*C22C 38/06* (2006.01)
*C21D 8/02* (2006.01)
*C22C 38/04* (2006.01)

(52) U.S. Cl.
CPC ..... *C22C 38/06* (2013.01); *C21D 8/0226* (2013.01); *C21D 8/0236* (2013.01); (Continued)

(58) Field of Classification Search
None
See application file for complete search history.

(56) References Cited

U.S. PATENT DOCUMENTS

2021/0222266 A1* 7/2021 Jin ..... C21D 8/0263

FOREIGN PATENT DOCUMENTS

KR 10-2011-0104118 A 9/2011
KR 10-1289902 B1 7/2013
(Continued)

OTHER PUBLICATIONS

International Search Report for PCT/KR2021/016379 dated Jan. 7, 2022 from Korean Intellectual Property Office.
(Continued)

*Primary Examiner* — Anthony M Liang
(74) *Attorney, Agent, or Firm* — Paratus Law Group, PLLC

(57) ABSTRACT

There is provided a ferritic lightweight steel which contains 2.0 to 3.0 wt % manganese (Mn), 5.0 to 6.0 wt % aluminum (Al) and 0.1 to 0.3 wt % carbon (C) and has a tensile strength of 900 MPa to 1,108 MPa. The lightweight steel includes ferrite-austenite dual grains as a result of performing low-temperature tempering-induced partitioning (LTP) at 300° C. for 10 minutes after isothermal annealing.

8 Claims, 16 Drawing Sheets

(52) U.S. Cl.
CPC ..... *C21D 8/0263* (2013.01); *C21D 8/0273* (2013.01); *C22C 38/04* (2013.01); *C21D 2211/001* (2013.01); *C21D 2211/005* (2013.01)

(56) References Cited

FOREIGN PATENT DOCUMENTS

| | | | |
|---|---|---|---|
| KR | 10-2015-0074959 | A | 7/2015 |
| KR | 10-2018-0126070 | A | 11/2018 |
| KR | 10-2018-0126580 | A | 11/2018 |
| KR | 10-2319479 | B1 | 10/2021 |

OTHER PUBLICATIONS

Korean Office Action for related KR Application No. 10-2020-0172118 dated Aug. 4, 2021 from Korean Intellectual Property Office.
Korean Notice of Allowance for related KR Application No. 10-2020-0172118 dated Oct. 21, 2021 from Korean Intellectual Property Office.

* cited by examiner

B

METHOD FOR MANUFACTURING FERRITIC LIGHTWEIGHT STEEL AND FERRITIC LIGHTWEIGHT STEEL USING SAME

CROSS-REFERENCE TO PRIOR APPLICATIONS

This application is a National Stage Patent Application of PCT International Patent Application No. PCT/KR2021/016379 (filed on Nov. 11, 2021) under 35 U.S.C. § 371, which claims priority to Korean Patent Application No. 10-2020-0172118 (filed on Dec. 10, 2020), which are all hereby incorporated by reference in their entirety.

BACKGROUND

The present invention relates to a method for producing a ferritic lightweight steel and a ferritic lightweight steel produced using the same, and more particularly, to a method for producing a cost-effective ferritic lightweight steel, which comprises performing low-temperature tempering for a short time, thereby maximizing structural stability, and increasing strength even at a low manganese content.

In general, for a weight reduction strategy in the industrial field, high-Mn steel is added to twinning-induced plasticity (TWIP) steels, or a large amount of Al is added to transformation-induced plasticity (TRIP) steels. The addition of 1 wt % Al reduces the density of the alloy by up to 1.3%, but for engineering applications, high-Al lightweight or low-density TWIP or TRIP steels have several disadvantages. When various thermodynamic events in lightweight steels occur, the stability of face-centered cubic (f.c.c.) austenite grains at high temperatures significantly decreases due to the high density of Al content. This makes austenite grains heterogeneous at room temperature due to the size and distribution of metastable austenite grains. Consequently, solid-state martensitic transformation during plastic deformation of heterogeneous metastable austenite is unpredictable, leading to premature TRIP at small deformations during tensile testing.

Conventionally used lightweight steels have an excellent elongation, but it was difficult to obtain a desired strength due to the addition of aluminum. The method proposed to overcome this difficulty is a method of adding manganese to increase strength, but when a large amount of manganese is added, a problem arises in that the process cost increases.

In order to solve the above-mentioned disadvantages, in the present invention, low-temperature tempering was performed after conventional thermal machining used in a wide range of industrial applications. Here, it was shown that, when the low-temperature tempering process was tuned, the strength and ductility of general ferritic LIGHT-TRIP-DP steels were simultaneously improved by partitioning the interstitial carbon atoms into heterogeneous metastable austenite. In particular, this tempering process was performed without loss of high dislocation density in metastable austenite grains.

SUMMARY

The present invention has been made to order to solve the above-described problems, and an object of the present invention is to provide a ferritic lightweight steel having ultra-high strength, high ductility and low density.

Another object of the present invention is to provide a ferritic lightweight steel which may be produced at reduced cost, by using solid solute elements such as Al and Mn to solve the problem with a problem of a conventional process that increases the process cost.

Objects to be solved by the present invention are not limited to the above-mentioned objects, and other objects not mentioned herein will be clearly understood by those of ordinary skill in the art to which the present invention pertains from the following description.

A method for producing a ferritic lightweight steel according to the present invention comprises steps of:

(1) subjecting an alloy to solution treatment at 1,200° C. for 90 minutes;
(2) hot-rolling the alloy, subjected to solution treatment, at 900° C. to 1,100° C.;
(3) air-cooling the hot-rolled alloy to room temperature at a cooling rate of 10° C./s;
(4) cold-rolling the air-cooled alloy at room temperature until a thickness of the alloy is reduced by 70%;
(5) subjecting the cold-rolled alloy to intercritical annealing (ICA) at 850° C. to 950° C. for 90 seconds;
(6) cooling the alloy, subjected to intercritical annealing, at a cooling rate of −10° C./s;
(7) isothermally annealing the cooled alloy at 430° C. for 50 seconds;
(8) air-cooling the isothermally annealed alloy; and
(9) subjecting the air-cooled alloy to low-temperature tempering-induced partitioning (LTP) at 300° C. for 10 minutes.

The lightweight steel is characterized by containing 2.0 to 3.0 wt % Mn, 5.0 to 6.0 wt % Al, and 0.1 to 0.3 wt % C.

Through the Technical Solution, according to the present invention, it is possible to produce a ferritic lightweight steel having ultra-high strength, high ductility and low-density.

In addition, according to the present invention, it is possible to produce a cost-effective ferritic lightweight steel at reduced cost by using solid solute elements such as Al and Mn to solve the problem with a problem of a conventional process that increases the process cost.

In addition, according to the present invention, it is possible to produce a ferritic lightweight steel having increased strength and ductility as a result of tuning a low-temperature tempering-induced partitioning (LTP) process.

In addition, according to the present invention, it is possible to improve the mechanical properties of steel by maximizing the structural stability of the steel through the low-temperature tempering-induced partitioning (LTP) process.

BRIEF DESCRIPTION OF THE DRAWINGS

FIG. 4(A) shows the volume fraction of metastable austenite grains as a function of tempering temperature for 10 minutes, and FIG. 4(B) shows SEM images of LTP steels tempered at 300° C. (top) and at 400° C. (bottom).

DETAILED DESCRIPTION

Figure 1:
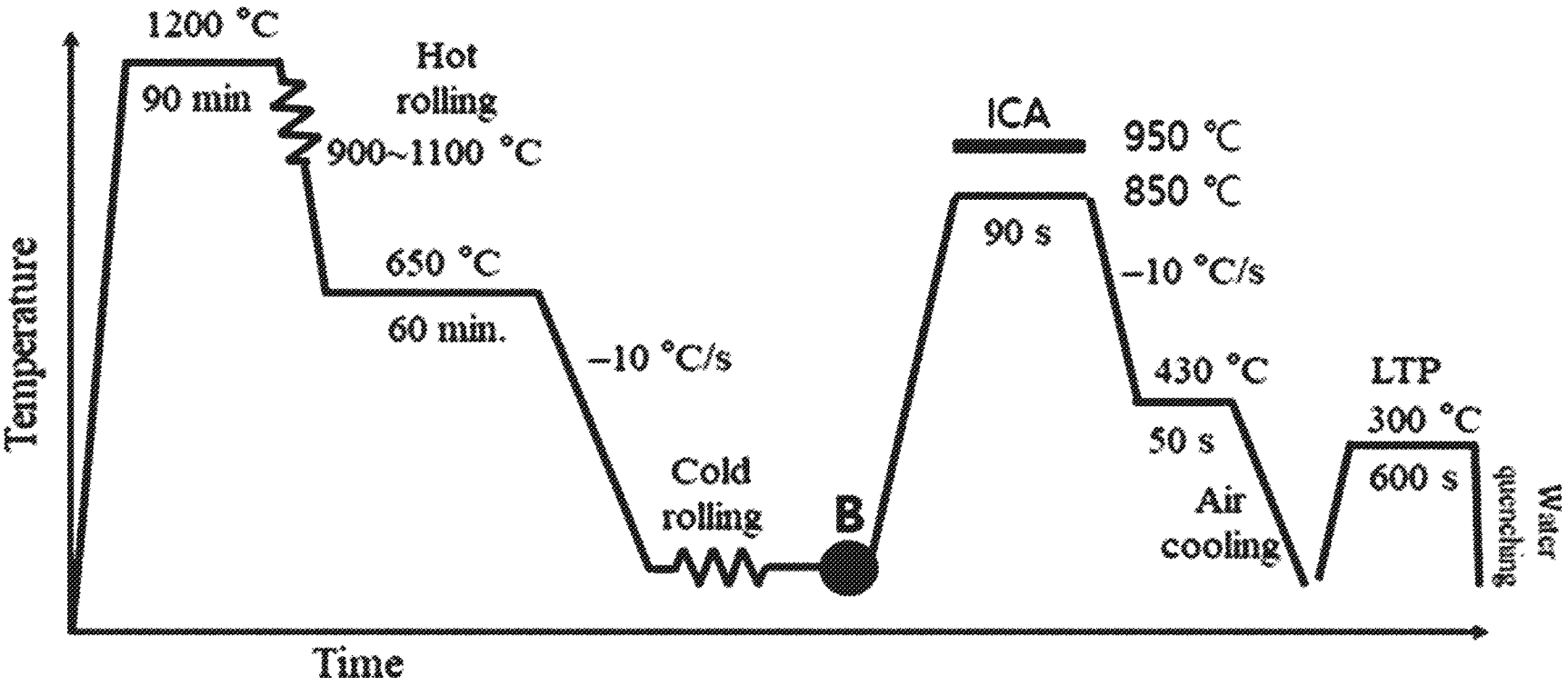
FIG. 1 is a schematic diagram showing a temperature versus time graph for a method for producing a ferritic lightweight steel according to the present invention.

Terms used in the present specification will be briefly described, and the present invention will be described in detail.

The terms used in the present invention are currently widely used general terms selected in consideration of their functions in the present invention, but they may change depending on the intents of those skilled in the art, precedents, or the advents of new technology. Accordingly, the terms used in the present invention should be defined based on the meaning of the term and the entire contents of the present invention, rather than the simple term name.

Throughout the present specification, it is to be understood that when any part is referred to as "including" any component, it does not exclude other components, but may further include other components, unless otherwise specified.

Hereinafter, embodiments of the present invention will be described in detail with reference to the accompanying drawings so that those of ordinary skill in the art to which the present invention pertains can easily carry out the present invention. However, the present invention may be embodied in various different forms and is not limited to the embodiments described herein.

Specific details including the technical problem, technical solution and effects of the present invention are included in the embodiments to be described below and the accompanying drawings. The advantages and features of the present invention, and the way of attaining them, will become apparent with reference to the embodiments described below in conjunction with the accompanying drawings.

Hereinafter, the present invention will be described in more detail with reference to the accompanying drawings.

Conventionally used lightweight steels have an excellent elongation, but it was difficult to obtain a desired strength due to the addition of aluminum. The method proposed to overcome this difficulty is a method of adding manganese to increase strength, but when a large amount of manganese is added, a problem arises in that the process cost increases. This causes a large loss in economic terms, and there has been a need for other methods. For these reasons, according to the present invention, it is possible to a so-called "cost-effective" lightweight steel by additionally performing a low-temperature tempering-induced partitioning (hereinafter referred to as LTP) process that makes it possible to obtain a desired strength while reducing the amount of manganese added.

In general, the FCC austenite phases of metal alloys and steels are stable at high temperatures. However, when various thermodynamic treatments are performed on LIGHT TRIP-DP (transformation-induced plasticity-dual phase) materials, the stability of austenite grains at high temperatures is significantly reduced. This makes the austenite grains irregular at room temperature, and makes the size and distribution of metastable austenite grains heterogeneous. LIGHT TRIP-DP alloys are different in metastable austenite grains from general TRIP-DP having a low Al content (less than 5 wt %). That is, the former constitutes heterogeneous lamellar metastable austenite grains embedded in a rough low-temperature stable BCC-ferrite matrix, whereas the latter forms a uniform distribution along grain boundaries. Consequently, solid-state martensitic transformation during plastic deformation of heterogeneous metastable austenite is unpredictable, leading to premature TRIP at small deformations during tensile testing.

A conventional process method comprises high-temperature heating, followed by high-temperature rolling and low-temperature rolling, and then annealing. However, as described above, the conventional method needs to be improved because it has a disadvantage in terms of strength and grain size imbalance occurs. When observing the microstructure after the rolling process, it can be observed that the microstructure is very heterogeneous. Therefore, heat treatment is performed again to cause recrystallization and phase transformation. After a total of two process steps are completed, a low-temperature tempering-induced partitioning (hereinafter referred to as LTP) process is performed for about 600 seconds at 300° C., which is a relatively lower temperature than the temperature of the previous process. According to the present invention, it is possible to maximize structural stability and improve mechanical properties, by performing the low-temperature tempering-induced partitioning (LTP) process.

The ferritic lightweight steel of the present invention is characterized by containing 2.0 to 3.0 wt % manganese (Mn), 5.0 to 6.0 wt % aluminum (Al), and 0.1 to 0.3 wt % carbon (C). In addition, the ferritic lightweight steel is characterized by having a ferrite volume fraction of 76.9% and an austenite volume fraction of 23.1%.

Mn is contained in an amount of 2.0 to 3.0 wt % to reduce process cost.

Figure 2:
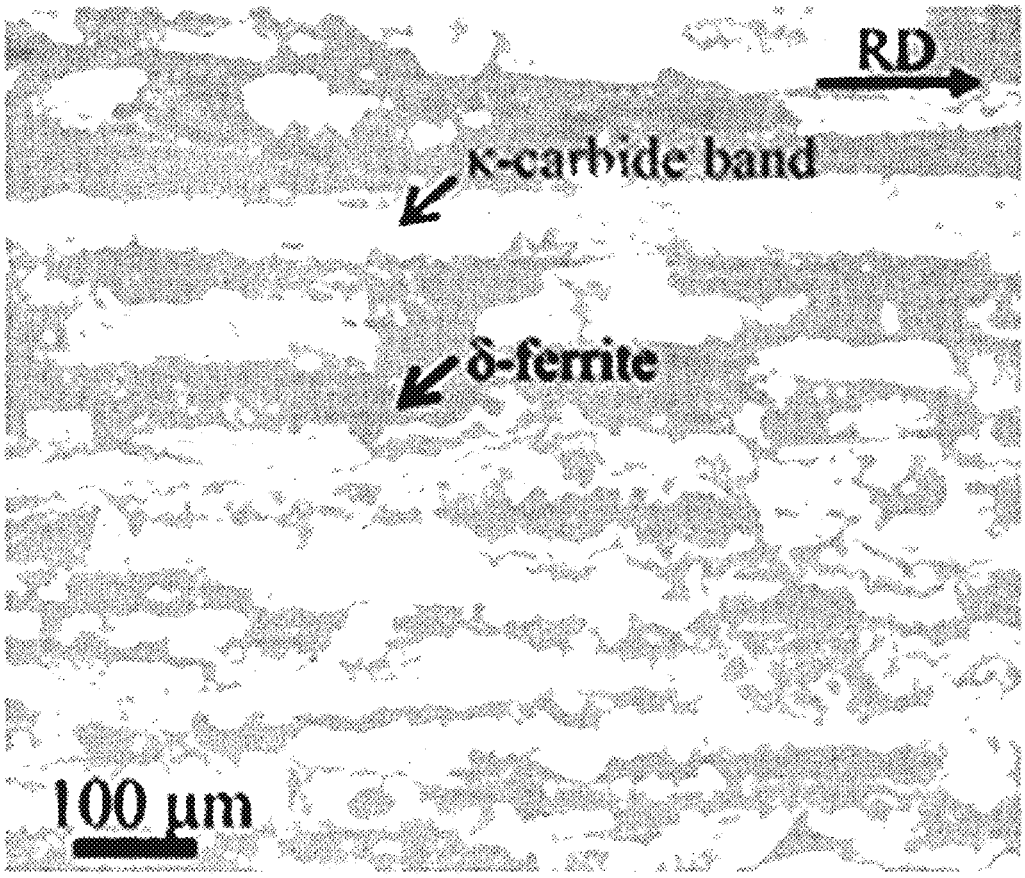
FIG. 2 is a photograph showing the overall microstructure of a cold-rolled steel in a section (shown as B in FIG. 1) before intercritical annealing (ICA).
Figure 3:
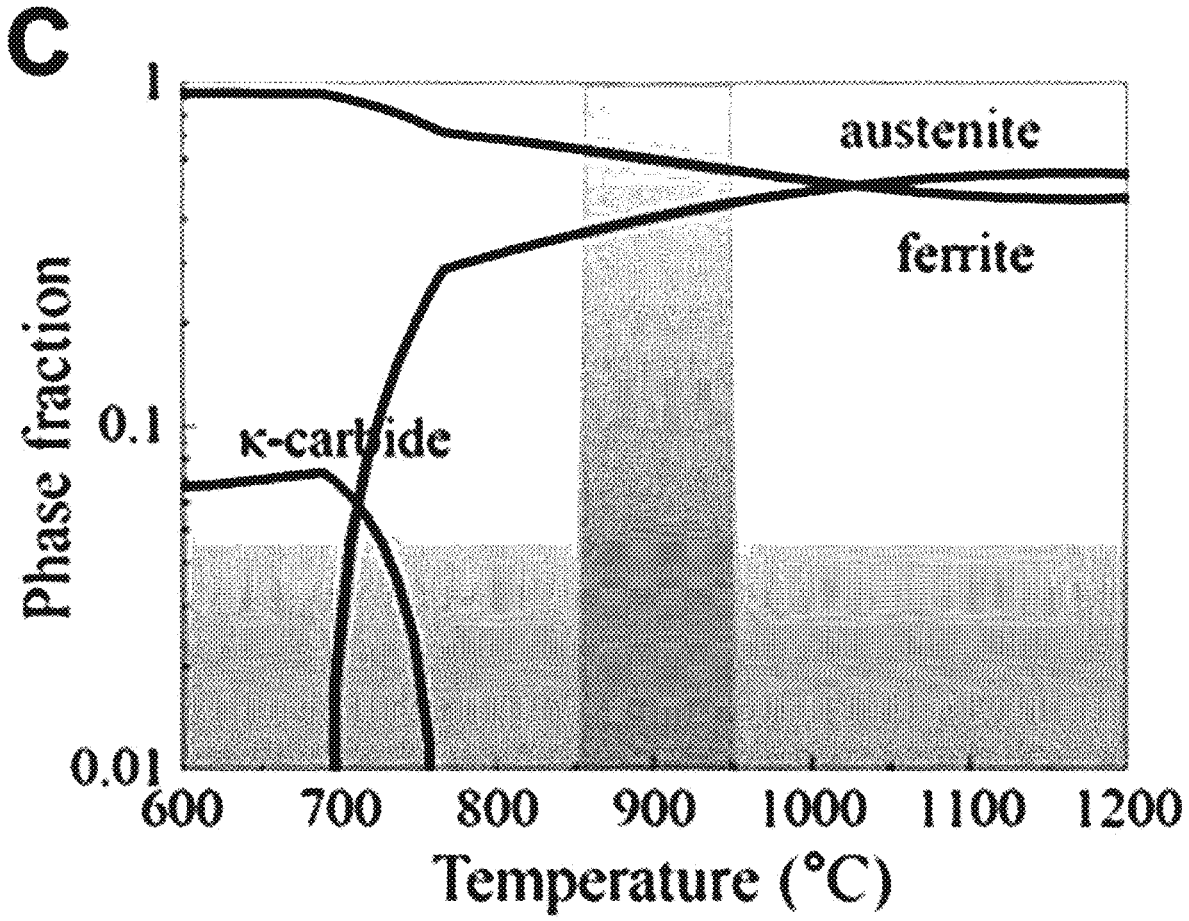
FIG. 3 is a graph showing the equilibrium phase fractions of ferrite, austenite and κ-carbide for low-temperature tempering-induced partitioning (hereinafter, LTP) steel as a function of temperature, calculated using Thermo-Calc according to one example of the present invention.

Al is contained in an amount of 5.0 to 6.0 wt % to reduce the mass density of the alloy and to suppress a harmful Fe—C-based precipitate. FIG. 2 is a photograph showing the overall microstructure of a cold-rolled steel in a section (shown as B in FIG. 1) before intercritical annealing (ICA). Here, the rolled steel shows a dual-phase microstructure including ferrite and κ-carbide, which is a precipitate rich in C—Al, along the rolling direction (RD).

C is contained in an amount of 0.1 to 0.3 wt %, and a rolled steel sheet containing 0.1 to 0.3 wt % C is subjected to intercritical annealing (hereinafter referred to as ICA) at 850° C. to 950° C.

Figure 4:
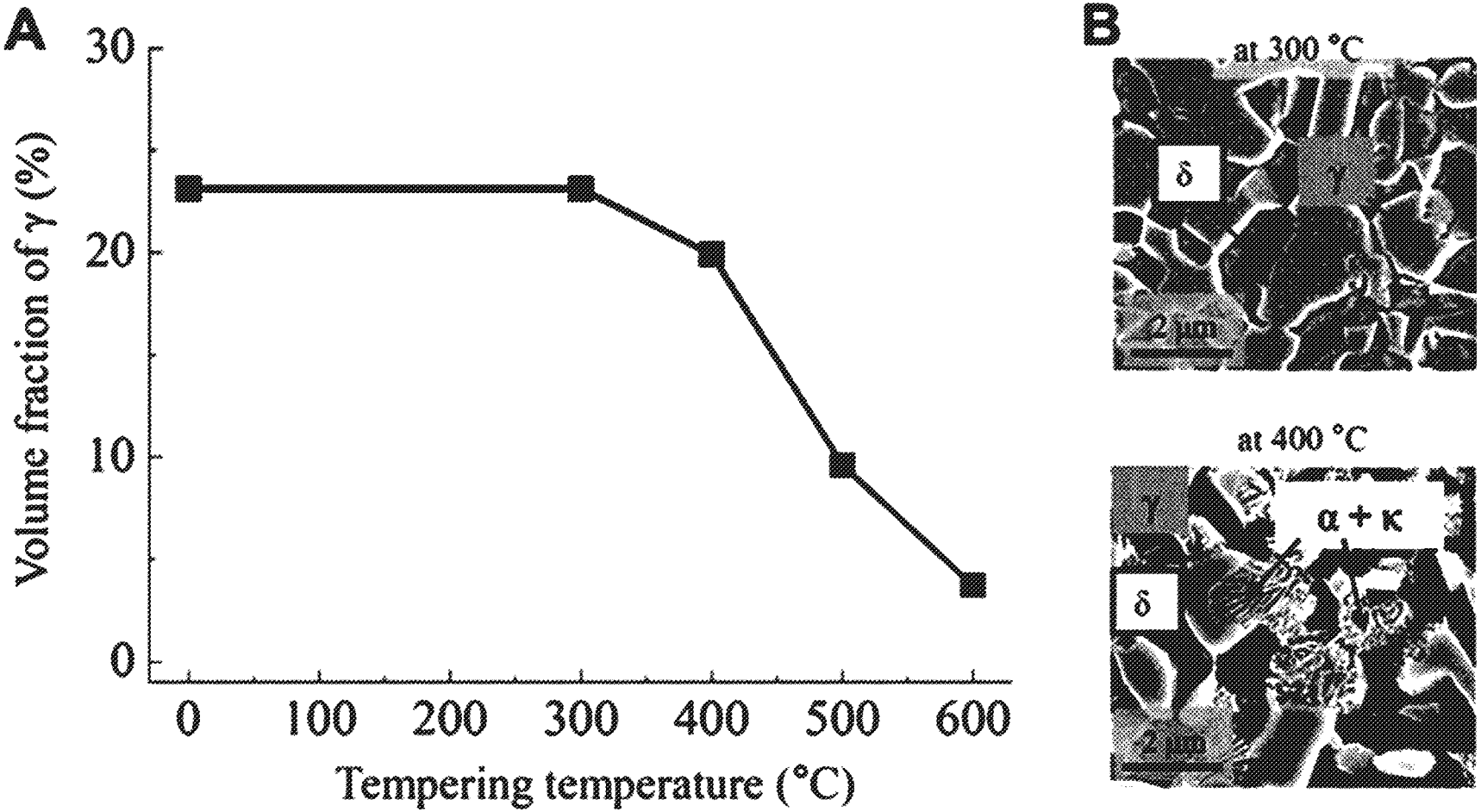
FIG. 4 shows changes in the fraction of metastable austenite grains during tempering. Specifically.

In one embodiment, a steel containing 0.3 wt % C was subjected to ICA (S50) at 850° C. (hereinafter referred to as followed by an isothermal annealing process (S70), and then a low-temperature tempering-induced partitioning (LTP) process was performed at 300° C. for 10 minutes. As a result, as shown in FIG. 4, the steel was composed of ferrite/austenite dual grains, and the austenite fraction decreased as the temperature increased. In addition, it was confirmed that, when the temperature was higher than 400° C., α-ferrite and κ-carbide were formed and the austenite volume fraction was lost.

Figure 5:
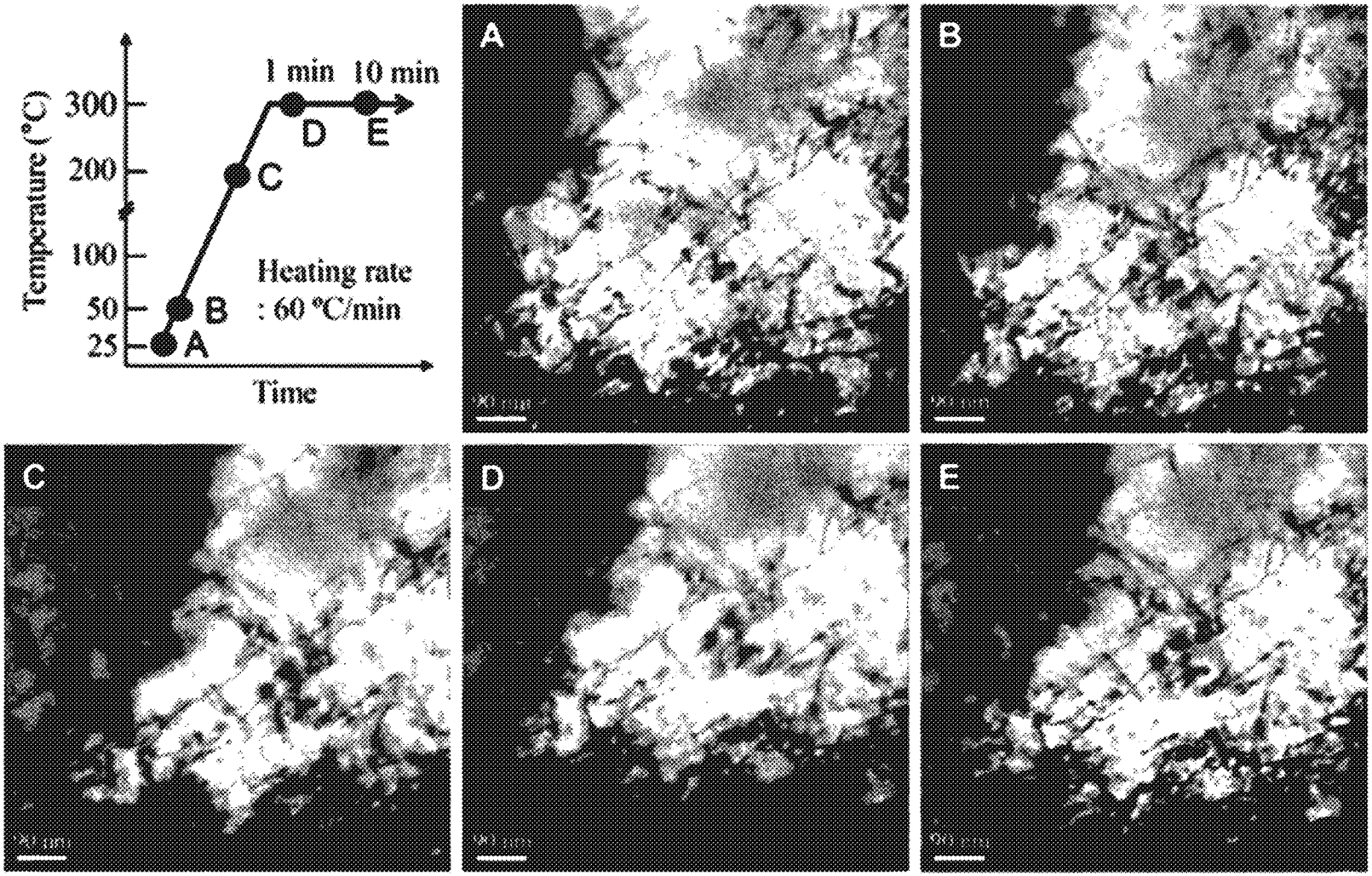
FIG. 5 depicts TEM images showing the microstructure of current steel before tensile testing, and shows that the dislocation density of the steel is not lost during LTP.

In one example, the sample obtained by performing LTP on the sample subjected to ICA (S50) at 0.3C-850 was analyzed by TEM up to 300° C. As a result, as shown in FIG. 5, it could be confirmed that the dislocation density was not lost during LTP, and LTP could be efficiently utilized for austenite stabilization.

The components of the ferritic lightweight steel after LTP are shown in Table 1 below.

TABLE 1

| Lightweight steel (wt %) | C | Mn | Al | Si | P | Fe |
|---|---|---|---|---|---|---|
| LTP | 0.1 to 0.3 | 2.0 to 3.0 | 5.0 to 6.0 | <0.01 | <0.01 | Base |

Figure 6:
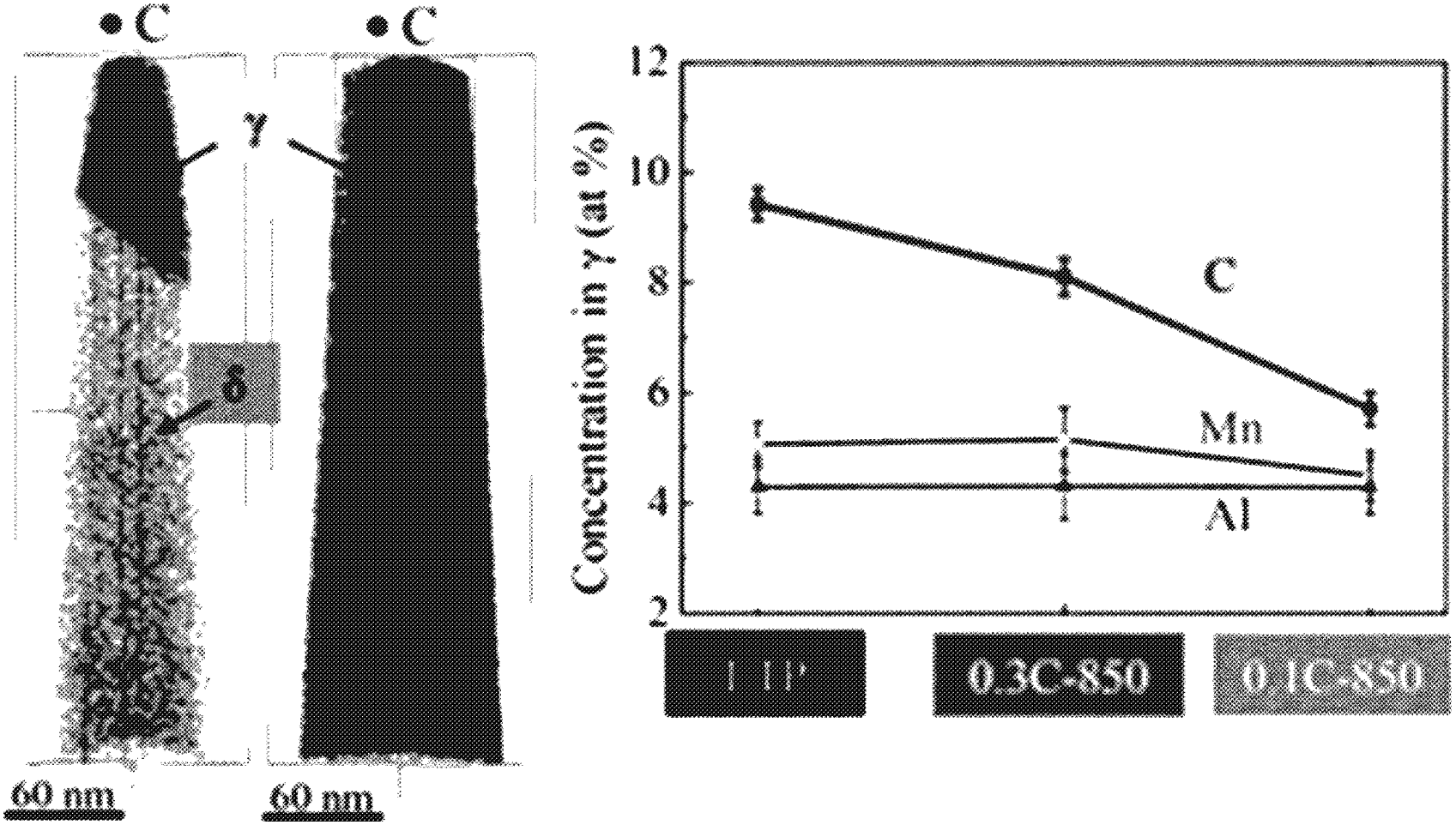
FIG. 6 shows 3D reconstructed carbon maps, and also shows 1D concentration profiles of C, Mn and Al taken from annealed γ grains of 0.1C-850 steel (left) and 0.3C-850 steel (right) and from metastable γ grains of each steel.
Figure 7:
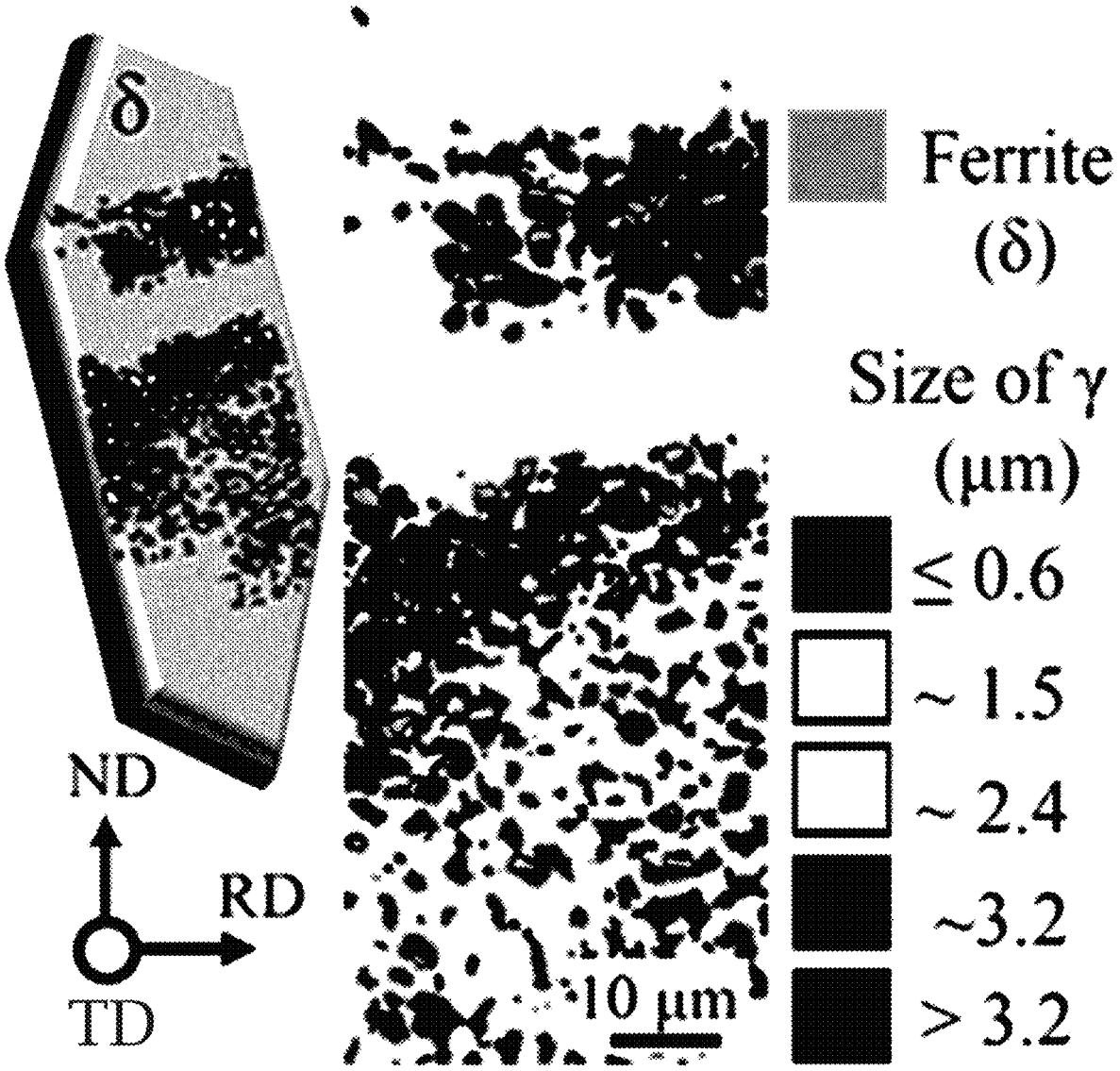
FIG. 7 shows typical electron backscatter diffraction (EBSD) pole-figure maps of fcc-austenite. Here, the transverse direction is perpendicular to the plane of 0.1C-850 steel (left) and 0.3C-850 steel (right), RD represents the rolling direction, and ND represents the vertical direction.

As shown by atomic probe tomography (APT) in FIG. 6, the concentration of C partitioned into metastable austenite grains after the LTP process in the present invention was measured. The difference in the concentration of Mn (which is another austenite stabilizing element) between the two steel samples LTP and 0.3C-850 was within the detection error range. Also, Al atoms showed a similar tendency to Mn. As shown in FIG. 7, all the steel samples including the LTP sample exhibited lamellar microstructures of layered metastable austenite grains embedded in a coarse ferrite matrix.

Figure 8:
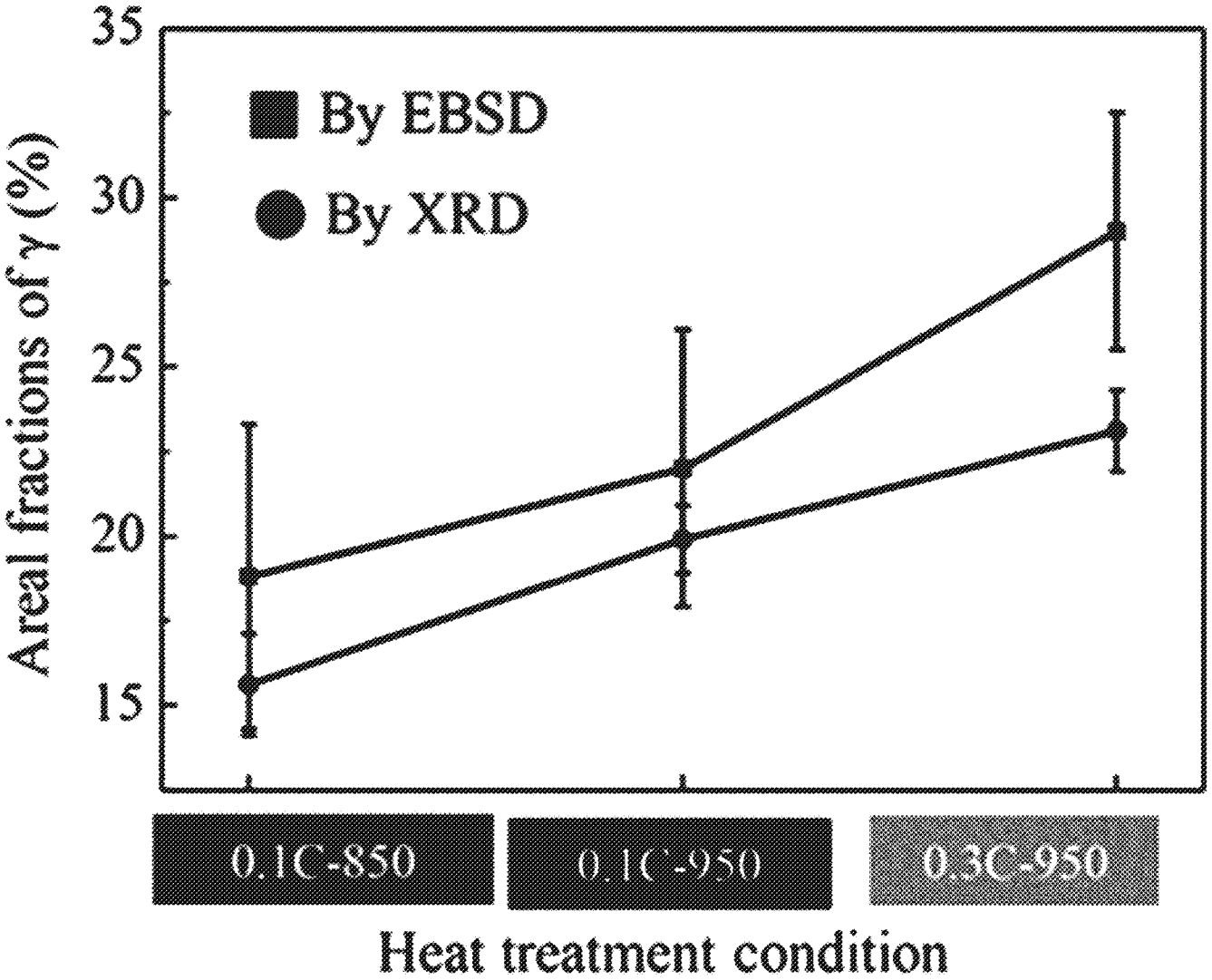
FIG. 8 is a graph showing the results of measuring the area fraction of metastable austenite grains in each of steels critically annealed to 0.1 and 0.3 wt % C before tempering.

The heterogeneity of metastable austenite grains in annealed (S70) steel indicates irregularities in position and grain sizes range from 0.45 to 4.2 μm. This heterogeneity is caused by the clustered microstructure, which forms a layer along the rolling direction (RD) in the rolled state. As shown in FIG. 8, the measurement of the areal fraction of metastable austenite grains determined by electron backscattering diffraction (EBSD) and conventional X-ray diffraction (XRD) indicated that an increase in carbon content or intercritical annealing temperature resulted in a higher austenite fraction.

Figure 9:
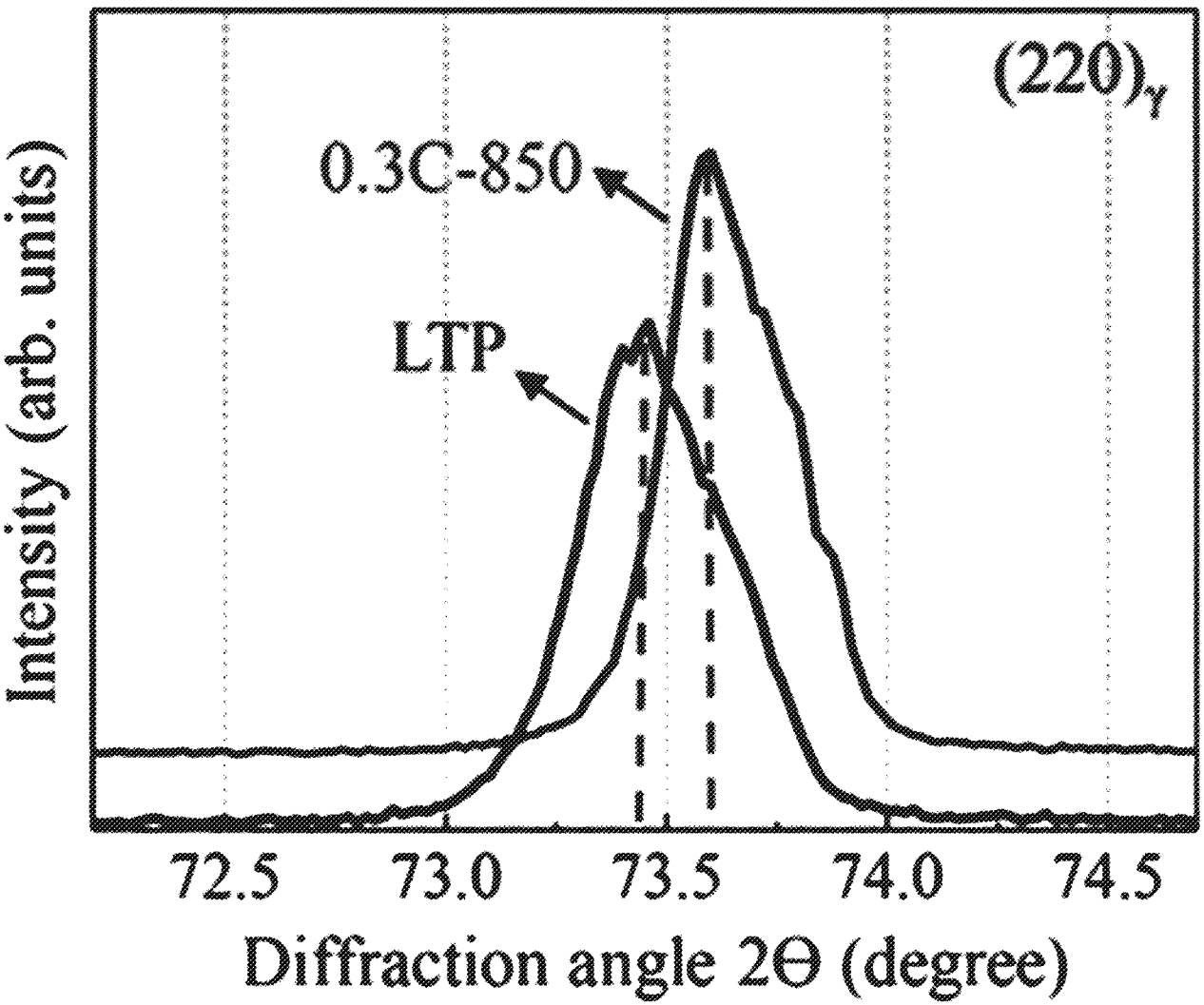
FIG. 9 is a graph showing the $(220)_{fcc}$ peaks of LTP (red) and non-LTP (blue) steels.

As shown in FIG. 9, the LTP process, which can partition more interstitial carbon atoms into metastable austenite grains, reduces the diffraction angle of the $(220)_{fcc}$ plane. This was revealed by synchrotron XRD and shows that the fcc-austenite lattice parameter was increased through LTP. The calculated interplanar $(220)_{FCC}$ d-spacings between the two steels were 0.12859 and 0.12880 nm, respectively. Based on the APT and XRD results, the addition of 1 at % C to metastable austenite increases the interval of (220) d-spacing by about 0.00018 nm. This means that the d-spacing interval of the $(111)_{fcc}$ slip plane is effectively increased by LTP.

Figure 10:
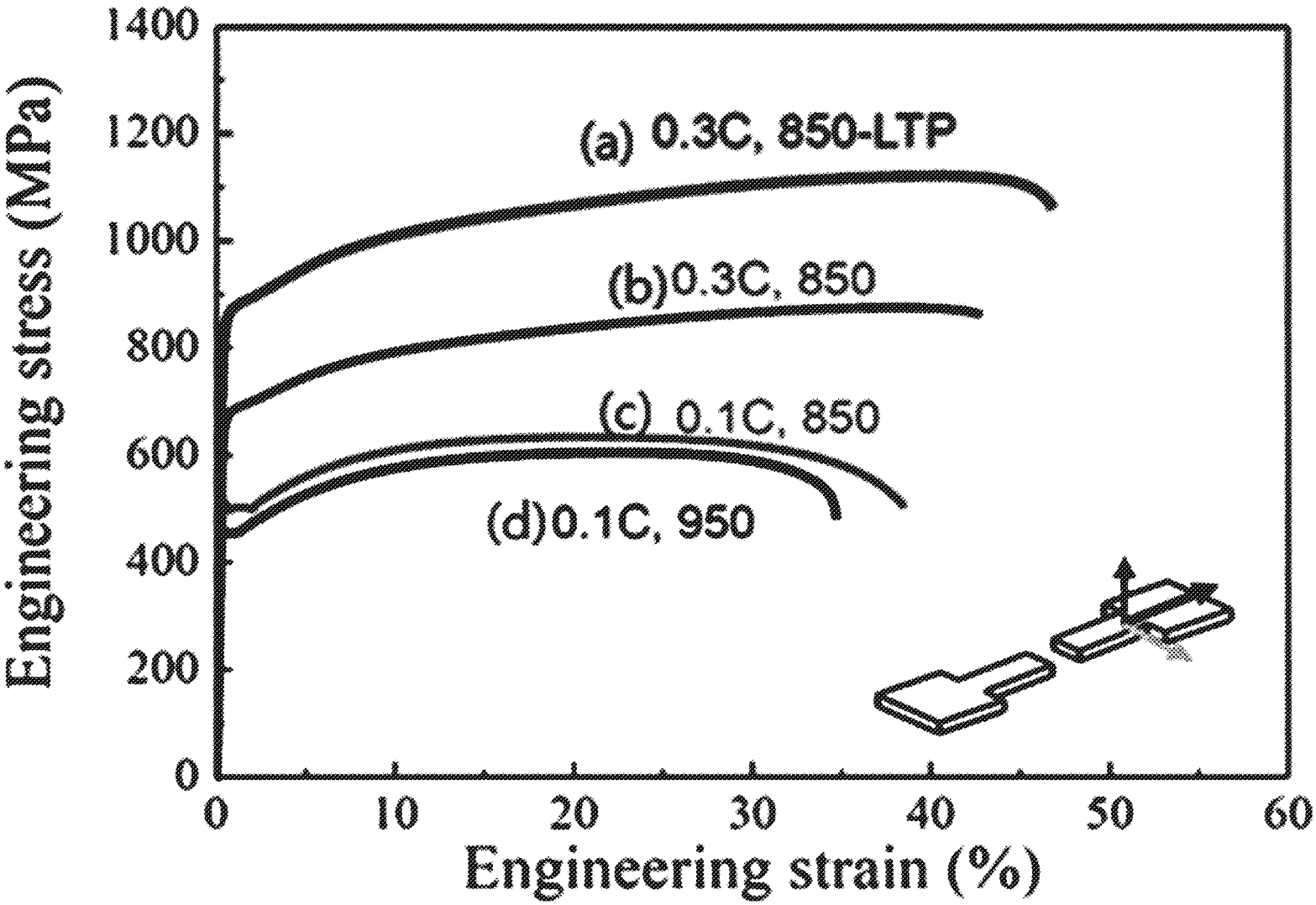
FIG. 10 is a graph showing tensile properties at room temperature. Here, (a) shows a steel subjected to LTP, and (b) to (d) are curves showing isothermally annealed non-LTP steels containing 0.1 wt % C (c and d) and 0.3 wt % C (b).
Figure 15:
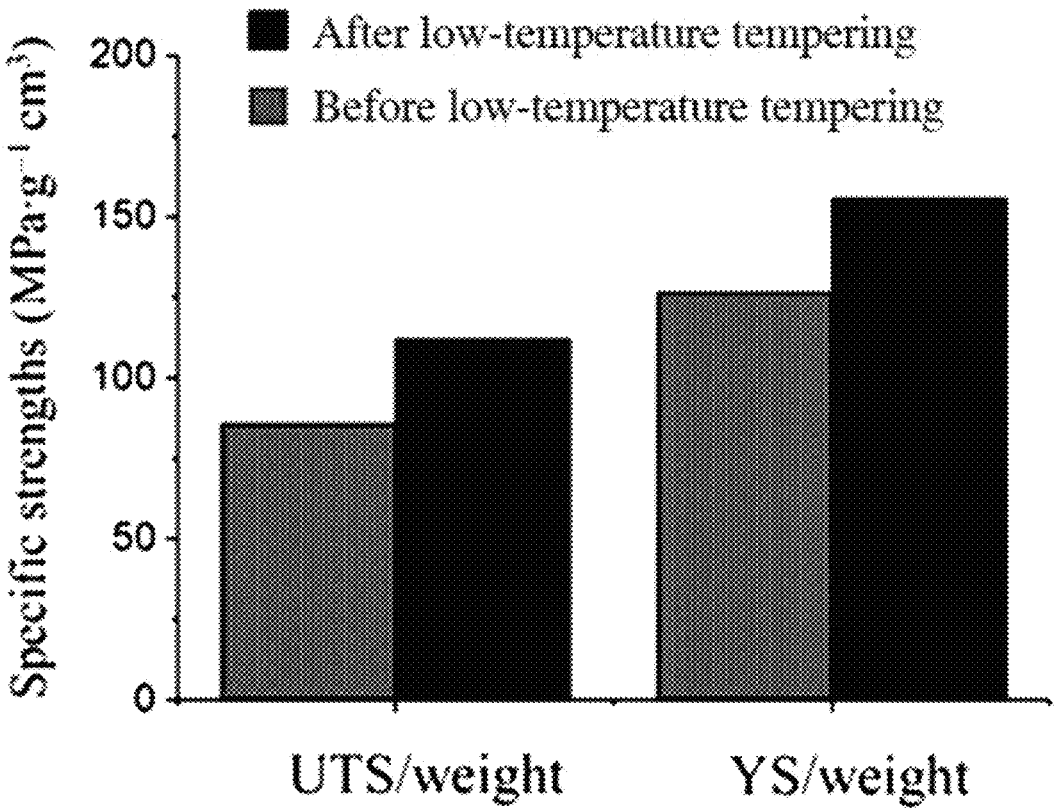
FIG. 15 is a graph showing a comparison of strength between before and after the LTP process.

FIG. 10 shows nominal stress-strain curves of steels (0.3C-850-LTP (a), 0.3C-850 (b), 0.1C-850 (c) and 0.1C-950 (d)). t can be seen that the room temperature tensile properties of the ferritic LIGHT-TRIP-DP alloy were remarkably improved through LTP. The yield strength increased from 610 MPa in the case of (b) to 798 MPa in the case of LTP steel. The ultimate tensile strength increased from 900 MPa to 1,108 MPa. The total elongation increased from 42.5% to 47% (absolute value). As the carbon content decreased from 0.3 wt % to 0.1 wt %, the tensile properties decreased. As a result of performing LTP (0.3C-850-LTP (a)), it could be confirmed that the steel could accommodate a larger amount of change while having a higher strength. In addition, as shown in FIG. 15, as a result of measuring specific strength, which is strength/weight, it was observed that the steel subjected to LTP had a higher specific strength.

Figure 11:
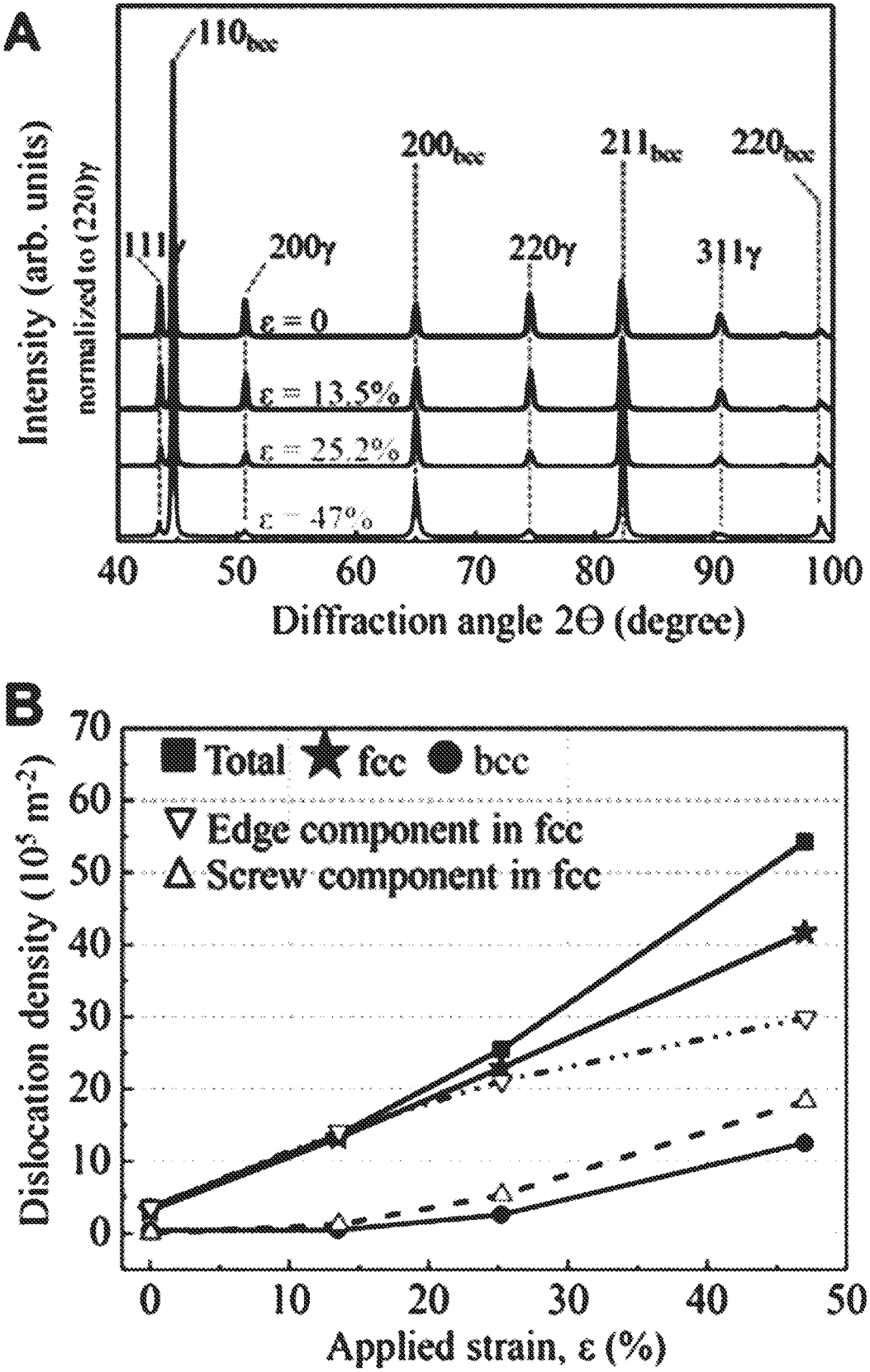
FIG. 11 shows the microstructure of LTP steel subjected to tensile testing, and shows synchrotron XRD profiles of the LTP steel at different strains.

To determine the dislocation density of LPT steels during tensile testing, bonding analysis was performed using synchrotron XRD and stepwise strain until the final sample fracture. The diffraction results obtained at different strain levels, i.e., strain ε=at 0% (annealed state), 13.5%, 25.2%, and 47.1%, are shown in FIG. 11(A). FIG. 11(B) shows that the metastable austenite in the undeformed LTP steel mostly contains edge dislocations with a density of $3.13\times10^{15}$ $m^{-2}$, whereas the ferrite matrix includes screw dislocations with a density of $4.48\times10^{14}$ $m^{-2}$.

FIG. shows changes in microstructures depending on rolling changes after LTP. It can be observed that, in a small zone, there is no significant change even as the rolling change increases, but in the coarse zone, the size increases as the amount of change increases.

Figure 12:
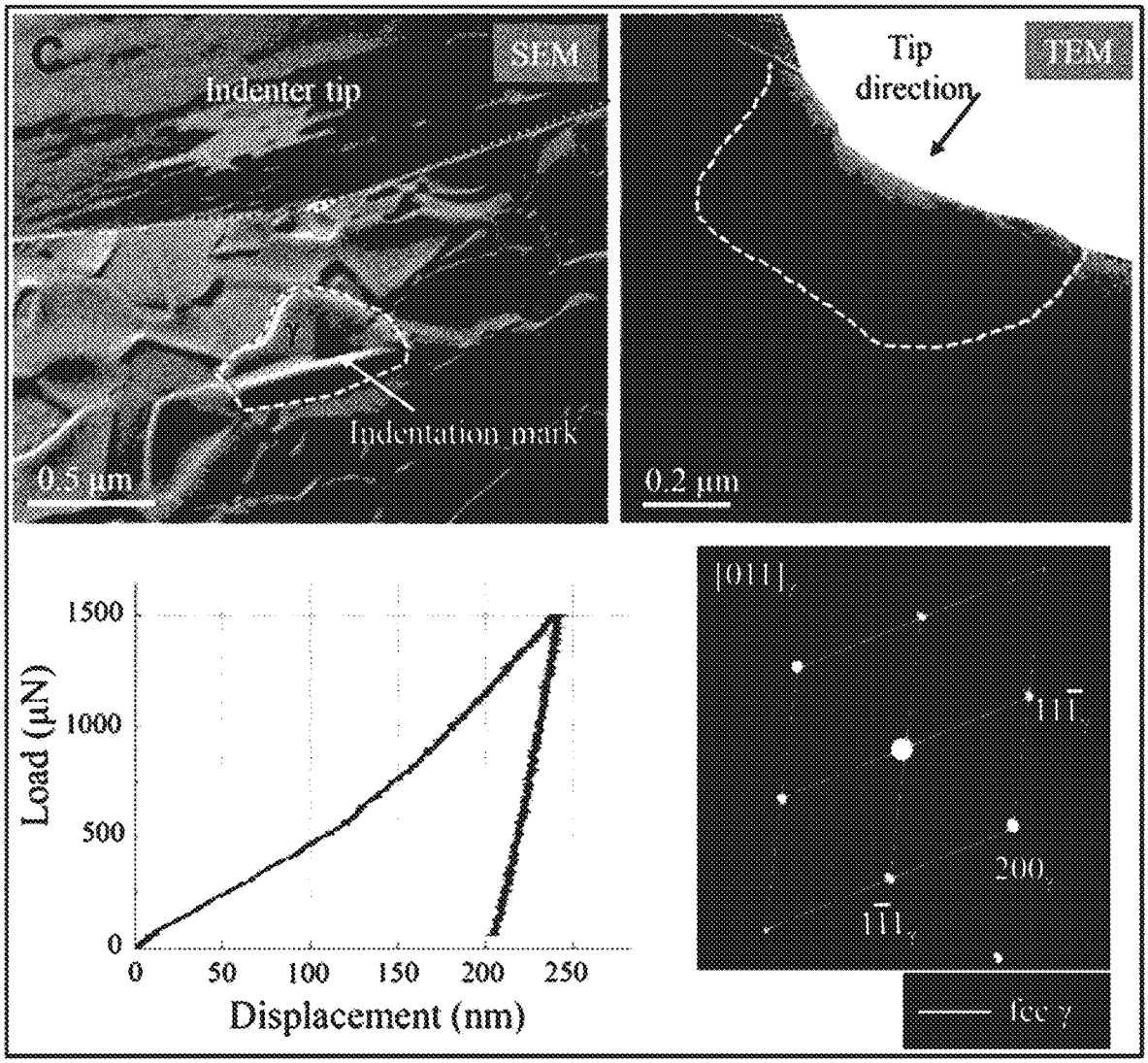
FIG. 12 shows the microstructure of LTP steel subjected to tensile testing, and depicts photographs showing the microscopic analysis of a small zone having a diameter of 0.5 μm or less.

Next, the grain size dependence of phase transformation due to strain in small- and coarse-grained austenite was examined. Nanoindentation test and TEM analysis were performed at the same location in the indenter-marked austenite region of small grains with a diameter of 0.5 μm or less and coarse grains with a diameter of 3.1 μm or less. The load-displacement curve in FIG. 12 shows that the small austenite grain resist martensite transformation caused by the nanoindentation load.

Figure 13:
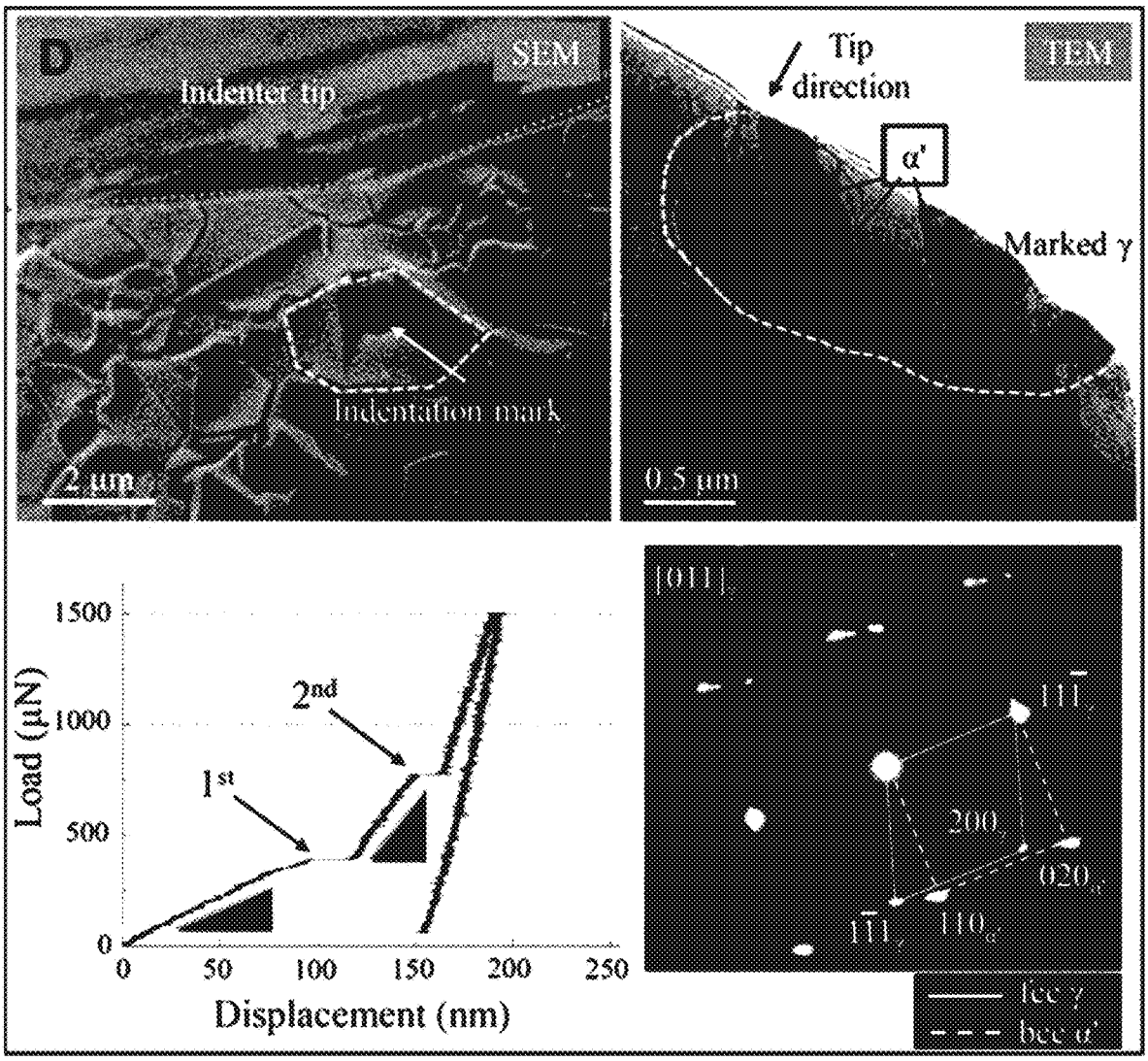
FIG. 13 shows the microstructure of LTP steel subjected to tensile testing, and depicts photographs showing the microscopic analysis of a coarse zone having a diameter of 3.0 μm or less.
Figure 14:
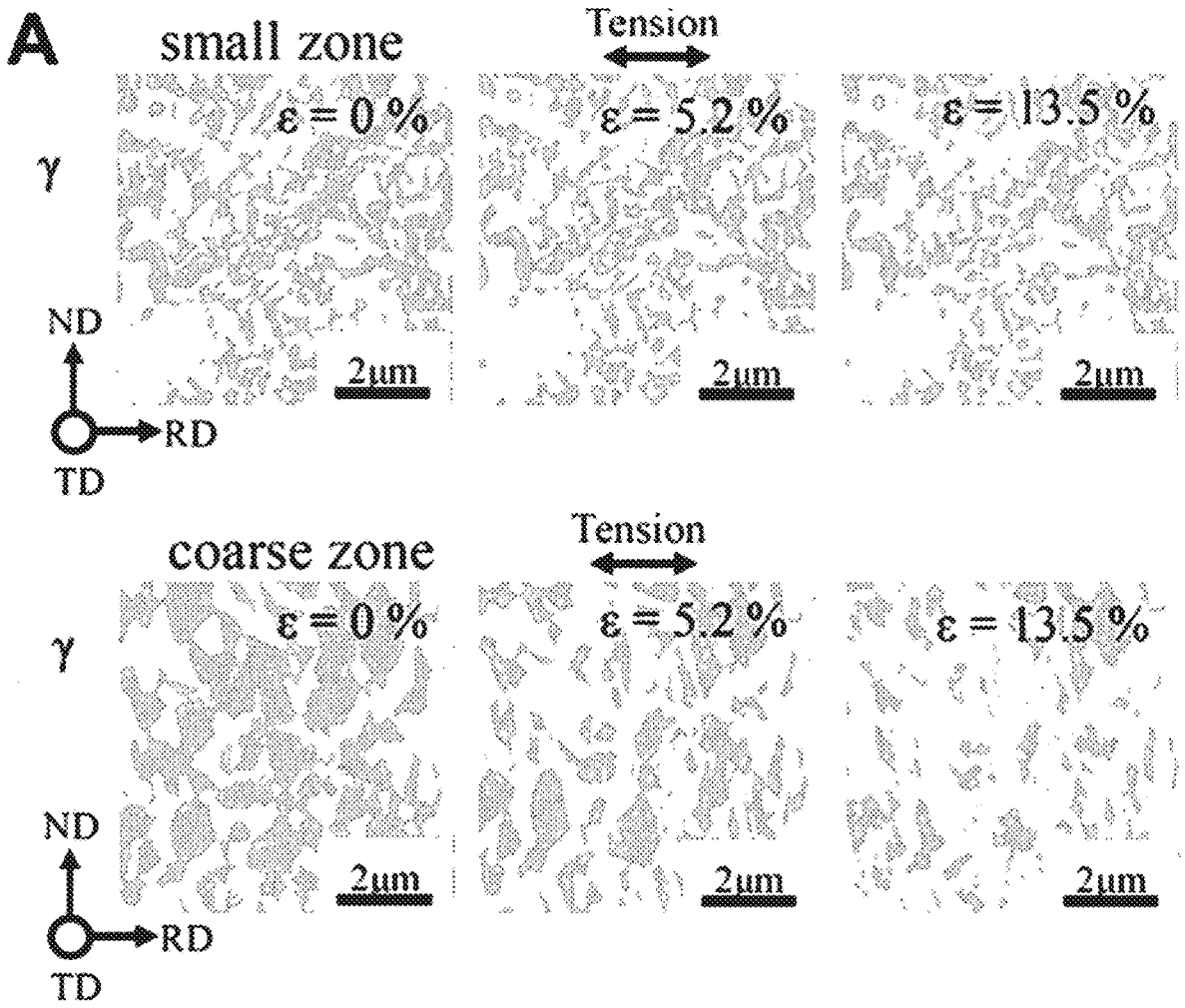
FIG. 14 depicts photographs showing changes in microstructures depending on rolling changes (ε=0%, ε=5.2%, ε=13.5%, ε=5.2%) in the small zone and the coarse zone after the low-temperature tempering-induced partitioning (LTP) process. Here, RD represents the rolling direction, ND represents a direction perpendicular to RD, and TD represents an observation direction.

This is also confirmed by the TEM image and the corresponding Selected Area Diffraction Pattern (SADP), as shown in FIG. 13, and is obtained under the targeted and depressed small austenite. In contrast, the pop-in events in the loading-unloading curves are clearly observed during the nanoindentation test of the coarse austenitic region in the LTP alloy. In addition, the slope after the first pop-in event rapidly increased compared to the slope before the first pop-in even at a constant loading speed. This slope increase is due to dislocation forest hardening through the formation of a continuous phase strain inside the coarse metastable austenite. This is supported by the TEM images, indicating that the austenite was locally transformed to a hard α'-martensite phase. The corresponding SAED pattern shows the existence of a common Kurdjumov-Sachs (K-S) relationship between the newly formed bcc α'-martensite and the parent fcc austenite. The total energy generated by strain-induced phase transformation was minimized by growing coarse austenite α'-martensite grains along the $<110>_{bcc}$ direction. The pop-in events occurred when an external stress was applied along the normal direction by the nano-indenter tip. That is, it is highly likely that the compression axis of the vane distortion is almost parallel to the indentation direction.

Figure 16:
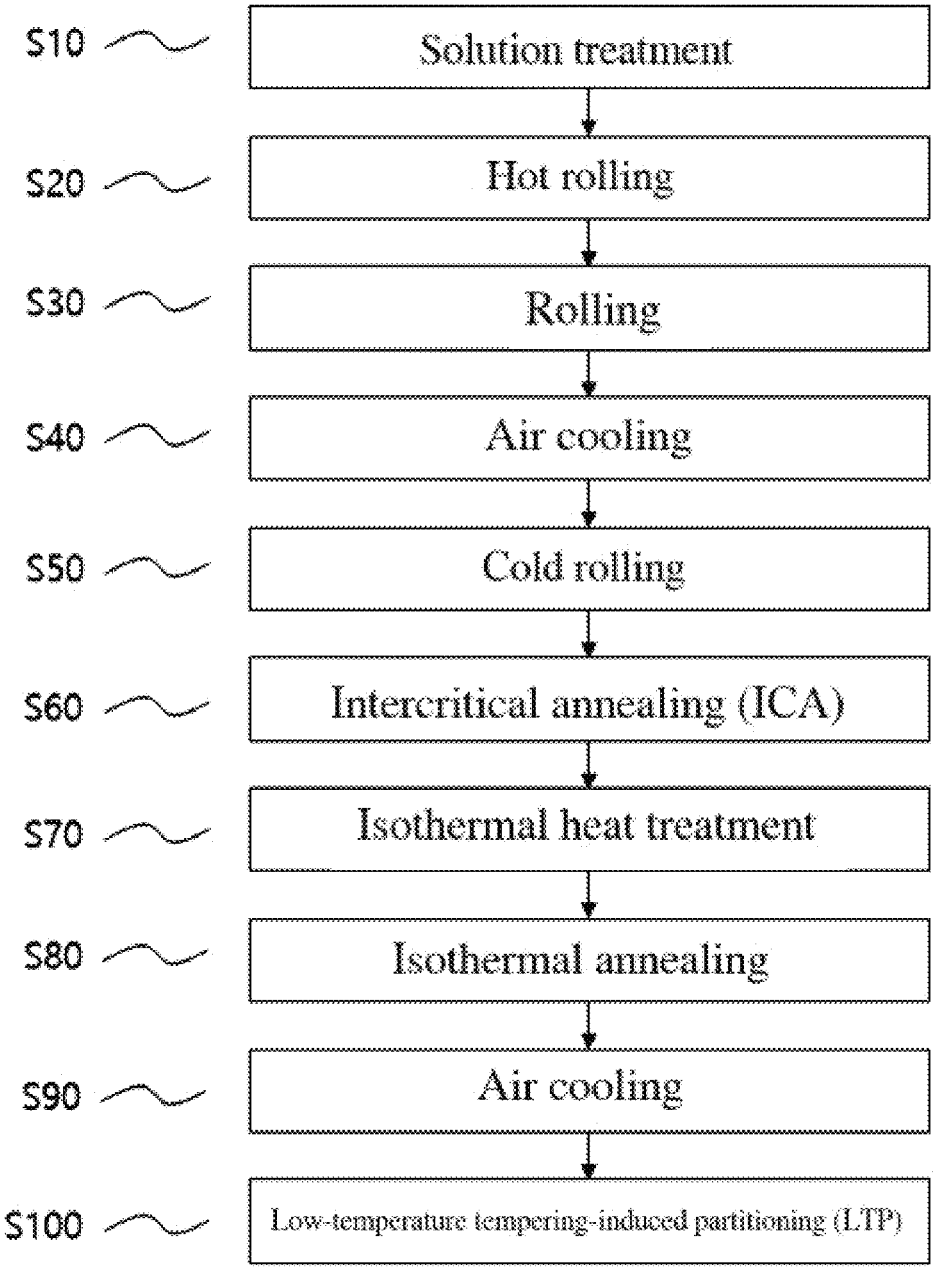
FIG. 16 is a flow chart showing a method of producing a ferritic lightweight steel according to the present invention.

The method for producing a ferritic lightweight steel according to the present invention is performed as shown in FIG. 16.

First, in step 1 (S10), an alloy is subjected to solution treatment at 1,200° C. for 90 minutes. The term "solution treatment" means softening an alloy by heating the alloy above the temperature at which the alloy melts to form a solid solution and maintaining the heated alloy for a sufficient time. Specifically, if the solid treatment is performed below 1,200° C., a problem may arise in that the fraction of the austenite phase is lowered, and if the solid treatment is performed above 1,200° C., a problem may arise in that the grain size of the austenite phase becomes excessively large. For these reasons, the solid treatment is preferably performed under the above-described conditions. In addition, if the solid treatment is performed for less than 90 minutes, a problem may arise in that the fraction of the austenite phase is lowered, and if the solid treatment is performed for more than 90 minutes, a problem may arise in that the grain size of the austenite phase becomes excessively large. For these reasons, the solid treatment is preferably performed under the above-described conditions.

The alloy is characterized by containing manganese (Mn), aluminum (Al) and carbon (C), and the lightweight steel produced by the method for producing a ferritic lightweight steel according to the present invention is characterized by containing 2.0 to 3.0 wt % manganese (Mn), 5.0 to 6.0 wt % aluminum (Al), and 0.1 to 0.3 wt % carbon (C).

Next, in step 2 (S20), the alloy subjected to solution treatment is hot rolled at 900° C. to 1100° C. In step 2 (S20), the thickness is reduced by 55% by hot rolling. More specifically, the hot rolling in step 2 (S20) is performed below 900° C., sufficient rolling to a predetermined thickness is impossible because the temperature interval up to the finish rolling temperature is narrow, and if the hot rolling is performed above 1,100° C., it may cause high temperature brittleness. Thus, the hot rolling is preferably performed under the above-described condition.

Next, in step 3 (S30), the hot-rolled alloy is air-cooled to room temperature at a cooling rate of 10° C./s. However, the hot-rolled alloy may be rolled at 650° C. for 60 minutes, and then air-cooled to room temperature. The hot-rolled alloy is produced in a coil shape.

Next, in step 4 (S40), the air-cooled alloy is cold-rolled at room temperature until the thickness is reduced by 70%.

As shown in FIG. 2, the rolled steel produced in step 4 (S40) shows a dual-phase microstructure containing: ferrite along the rolling direction (RD); and κ-carbide (volume fraction: 38.6%) which is a precipitate rich in C—Al along the rolling direction (RD). The κ-carbide band structure formation is mainly due to the solute partitioning effect during casting of high-aluminum lightweight steel. Step 4 (S40) is performed at a low temperature of room temperature.

Next, in step 5 (S50), the cold-rolled alloy is subjected to intercritical annealing (ICA) at 850° C. to 950° C. for 90 seconds. In the cold-rolled alloy, ferrite and austenite are produced while step 5 (50) is performed. The temperature at which step 5 (S50) is performed is selected to dissolve κ-carbide phase completely, based on the thermodynamic calculations of the quaternary Fe—Mn—Al—C systems.

More specifically, if the intercritical annealing in step 5 (S50) is performed below 850° C., residual austenite is likely to remain, and the intercritical annealing is performing for the purpose the alloying elements sufficiently. For this reason, the intercritical annealing does not need to be performed above 950° C.

Next, in step 6 (S60), the alloy subjected to intercritical annealing is cooled at a cooling rate of −10° C./s.

Next, in step 7 (S70), the cooled alloy is isothermally annealed at 430° C. for 50 seconds.

Next, in step 8 (S80), the isothermally annealed alloy is air-cooled.

Next, in step 9 S90, the air-cooled alloy is subjected to low-temperature tempering-induced partitioning (LTP) at 300° C. for 10 minutes. In the isothermally annealed alloy, a dual-phase microstructure consisting of ferrite and austenite is formed by performing step 9 (S90). The tempering in step 9 (S90) is preferably performed until the precipitates precipitate and reach an equilibrium phase.

More specifically, if the low-temperature tempering-induced partitioning (LTP) in step 9 (S90) is performed below 300° C., a problem may arise in that the precipitates do not precipitate, and if the low-temperature tempering-induced partitioning (LTP) is performed above 300° C., a problem may arise in that the precipitates are coarsened, resulting in degradation in mechanical properties and an increase in the production cost. For these reason, the low-temperature tempering-induced partitioning (LTP) is preferably performed under the above-described conditions. If the low-temperature tempering-induced partitioning (LTP) in step (S90) is performed for less than 10 minutes, a problem may arise in that the precipitates do not precipitate, and if the low-temperature tempering-induced partitioning (LTP) is performed for more than 10 minutes, a problem may arise in that sufficient energy may be obtained, resulting in grain coarsening. For these reasons, the low-temperature tempering-induced partitioning (LTP) is preferably performed under the above-described conditions.

In previous studies, those having a tensile strength of 1 GPa or more and an elongation of 7% or more were main products. However, through the LTP process of the present invention, a ferrite phase became the main structure of the alloy, the yield strength of the alloy increased from 610 MPa to 798 MPa, and the ultimate tensile strength increased from 900 MPa to 1,108 MPa. Also, the total elongation increased from 42.5% to 47% (absolute value).

According to the Technical Solution of the present invention, it is possible to produce a ferritic lightweight steel having ultra-high strength, high ductility and low density.

In addition, according to the present invention, it is possible to produce a ferritic lightweight steel at reduced cost, by using solid solute elements such as Al and Mn to solve the problem with a problem of a conventional process that increases the process cost.

In addition, according to the present invention, it is possible to produce a ferritic lightweight steel having increased strength and ductility as a result of tuning a low-temperature tempering-induced partitioning (LTP) process.

In addition, according to the present invention, it is possible to improve the mechanical properties of steel by maximizing the structural stability of the steel through the low-temperature tempering-induced partitioning (LTP) process.

While the present invention has been described with reference to the particular illustrative embodiments, it will be understood by those skilled in the art to which the present invention pertains that the present invention may be embodied in other specific forms without departing from the technical spirit or essential characteristics of the present invention.

Therefore, the embodiments described above are considered to be illustrative in all respects and not restrictive. Furthermore, the scope of the present invention is defined by the appended claims rather than the detailed description, and it should be understood that all modifications or variations derived from the meanings and scope of the present invention and equivalents thereto are within the scope of the present invention.

The invention claimed is:

1. A method for producing a ferritic steel, the method comprising steps of:

(1) subjecting an alloy to solution treatment at 1,200° C. for 90 minutes;

(2) hot-rolling the alloy, subjected to solution treatment, at 900° C. to 1,100° C.;

(3) air-cooling the hot-rolled alloy to room temperature at a cooling rate of 10° C./s;

(4) cold-rolling the air-cooled alloy at room temperature until a thickness of the alloy is reduced by 70%;

(5) subjecting the cold-rolled alloy to intercritical annealing at 850° C. to 950° C. for 90 seconds;

(6) cooling the alloy, subjected to intercritical annealing, at a cooling rate of 10° C./s;

(7) isothermally annealing the cooled alloy at 430° C. for 50 seconds;

(8) air-cooling the isothermally annealed alloy; and (9) subjecting the air-cooled alloy to low-temperature tempering-induced partitioning (LTP) at 300° C. for 10 minutes, wherein a steel resulting from step (9) contains 2.0 to 3.0 wt % manganese (Mn), 5.0 to 6.0 wt % aluminum (Al) and 0.1 to 0.3 wt % carbon (C).

2. The method according to claim 1, wherein the steel comprises ferrite/austenite dual grains as a result of performing the low-temperature tempering-induced partitioning (LTP) in step (9).

3. The method according to claim 2, wherein a volume fraction of the ferrite is 76.9%, and a volume fraction of the austenite is 23.1%.

4. The method according to claim 1, wherein the steel has a tensile strength of 900 MPa to 1,108 MPa.

5. The method according to claim 1, wherein the steel has a total elongation of 42.5% to 47%.

6. The method according to claim 1, wherein the steel has a yield strength of 610 MPa to 798 MPa.

7. The method according to claim 1, wherein, when the cold rolling in step (4) is performed, ferrite and κ-carbide are alternately aligned and form a precipitate band structure along a rolling direction.

8. The method according to claim 1, wherein the hot rolling in step (2) is performed until a thickness of the alloy is reduced by 55%.

* * * * *